US007246588B2

(12) United States Patent
Takano et al.

(10) Patent No.: US 7,246,588 B2
(45) Date of Patent: Jul. 24, 2007

(54) ASSEMBLED CAMSHAFT FOR ENGINE AND PRODUCTION METHOD THEREOF

(75) Inventors: Hiroshi Takano, Yokohama (JP); Tomoyuki Hirota, Yokohama (JP); Yujiro Ohara, Kamakura (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 10/434,338

(22) Filed: May 9, 2003

(65) Prior Publication Data

US 2003/0230260 A1 Dec. 18, 2003

(30) Foreign Application Priority Data

Jun. 13, 2002 (JP) ..... 2002-172952

(51) Int. Cl.
*F01L 1/04* (2006.01)

(52) U.S. Cl. ..... 123/90.6; 123/90.27; 29/888.1

(58) Field of Classification Search ..... 123/90.15, 123/90.16, 90.17, 90.18, 90.27, 90.31, 90.34, 123/90.6; 29/888.1; 74/567, 568 R
See application file for complete search history.

(56) References Cited

U.S. PATENT DOCUMENTS

| | | | | |
|---|---|---|---|---|
| 1,527,456 | A * | 2/1925 | Woydt et al. | 74/568 R |
| 4,293,995 | A * | 10/1981 | Jordan | 29/421.1 |
| 4,575,913 | A * | 3/1986 | Sugiuchi et al. | 29/432 |
| 4,597,365 | A * | 7/1986 | Madaffer | 123/90.6 |
| 5,040,294 | A * | 8/1991 | Harle | 29/888.1 |
| 5,259,268 | A * | 11/1993 | Ebbinghaus et al. | 74/567 |
| 5,299,881 | A * | 4/1994 | Mettler-Friedli | 403/274 |
| 6,286,196 | B1 * | 9/2001 | Vogel | 29/421.1 |
| 2003/0097999 | A1 * | 5/2003 | Spiegel et al. | |

FOREIGN PATENT DOCUMENTS

JP 11-270307 A 10/1999

* cited by examiner

*Primary Examiner*—Ching Chang
(74) *Attorney, Agent, or Firm*—Foley & Lardner LLP

(57) ABSTRACT

An assembled camshaft (10) for engine includes: a cam lobe piece (12); and a hollow shaft member (11) having at least two shaft fixing surfaces (11A) formed by plasticity process on a portion of the hollow shaft member (11) corresponding to a position between cylinders of the engine.

16 Claims, 10 Drawing Sheets

ASSEMBLED CAMSHAFT FOR ENGINE AND PRODUCTION METHOD THEREOF

BACKGROUND OF THE INVENTION

1. Field of the Invention

The present invention relates to an assembled camshaft for engine and a production method thereof, and more particularly to the assembled camshaft including a cam lobe piece and a hollow shaft member and the production method thereof.

2. Description of the Related Art

As an environment surrounding automobile, an improvement in fuel consumption has become a major social concern, and as its countermeasure, lightening of parts has been received keen attention.

As for the lightening of a camshaft for engine, there suggests an assembly system in which a cam lobe piece is mechanically fastened to a hollow shaft member. In the assembled camshaft, a sprocket which is driven to be rotated by a belt or a chain is fastened by a bolt. For this reason, the camshaft requires a structure for receiving a reaction force at the time of fastening the sprocket.

For example, there suggest a structure having a hexagonal nut shaped part which is inserted and fastened in a mouth expanded manner, a structure having a slit (excavation or groove) (see Japanese Patent Application Laid-Open No. 11-270307 (1999)), and a structure having a plane which is cut to be formed.

However, the structure having the hexagonal nut shaped parts causes an increase in cost due to an increase in number of parts and a loss of a lightening effect. Further, since a size of the hexagon is large, there arises a problem that a degree of a design freedom of an engine, particularly of a cylinder head portion, is lowered.

Since the structure having a slit requires a special exclusive working tool, there arises a problem that attachment/detachment of the camshaft is difficult in a general service factory. Namely, since a work using the special working tool is forcibly required in a machine maintenance business, maintainability has a problem.

Further, in the structure having the plane cut to be formed, lowering of mechanical durability is feared. On the contrary, in the case where an entire thickness is previously kept according to a thickness after the cutting, lightening of parts is inhibited.

SUMMARY OF THE INVENTION

The present invention is devised in order to solve the problems of the conventional arts. Therefore, it is an object of the present invention is to provide a light assembled camshaft for engine having good mechanical durability and maintainability, and a production method thereof.

To achieve the object, according to a first aspect of the present invention, there is provided a assembled camshaft for engine having a cam lobe piece and a hollow shaft member wherein the hollow shaft member has at least two shaft fixing surfaces which are formed by a plasticity process on a portion corresponding to a position between cylinders. The shaft fixing surfaces function as rotation brakes of the shaft member at the time of fastening a sprocket.

According to a second aspect of the present invention, there is provided a production method of an assembled camshaft for engine having a cam lobe piece and a hollow shaft member including a step of forming by a plasticity processing tool at least two shaft fixing surfaces on a portion of the hollow shaft member corresponding to a position between cylinders.

Since an additional part such as a hexagonal nut shaped part is not necessary, an increase in cost due to an increase in number of parts and a loss of a lightening effect do not occur. Since the shaft fixing surface is formed by the plasticity process, a decrease in a thickness is suppressed, and mechanical durability is easily secured without hindering the lightening of parts.

In addition, a special exclusive working tool is not necessary, and the camshaft can be easily attached/detached by a working tool such as a spanner. Since a distance between the cam lobe pieces is long and a working space can be secured easily, the working tool is easily inserted. Namely, interference between the working tool and the parts hardly occurs, and satisfactory assembly workability can be secured.

Further, since the distance between the cam lobe pieces is long, the shaft fixing surface can be arranged easily so that deformation of the hollow shaft member which is caused by the forming of the cam shaft surface, does not influence a fastened portion of the cam lobe member. Therefore, reliability of the fastening force of the cam lobe piece can be secured.

Therefore, the light assembled camshaft for engine having satisfactory mechanical durability and maintainability can be provided.

In addition, the light assembled camshaft for engine having the satisfactory mechanical durability and maintainability can be provided. Particularly, since the distance between the cam lobe pieces is long, a degree of design freedom of the plasticity processing tool for forming the shaft forming surface is large. Therefore, in this production method, the plasticity processing tool having large rigidity and long life can be used.

BRIEF DESCRIPTION OF THE DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
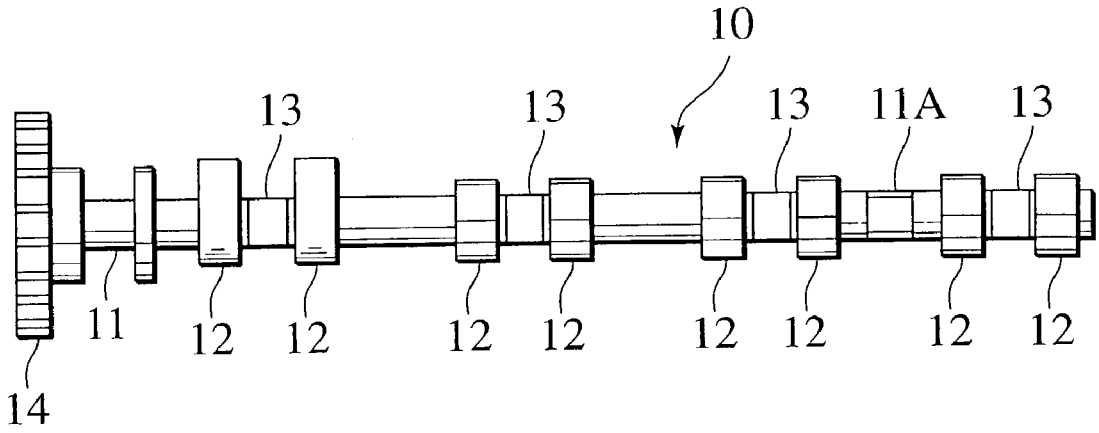
FIG. 1 is a front view of an assembled camshaft for engine according to an embodiment of the present invention.

There will be detailed below the preferred embodiments of the present invention with reference to the accompanying drawings. Like members are designated by like reference characters.

As shown in FIG. 1, an assembled camshaft 10 for engine according to an embodiment of the present invention has a hollow shaft member 11, a plurality of cam lobe pieces 12 and journals 13.

In addition, one end of the hollow shaft member 11 is fastened to a sprocket 14 which is driven to be rotated by a belt or a chain. The cam lobe piece 12 is, for example, a forging or a sinter, and it is located with a phase difference corresponding to a crank angle and is fitted into the hollow shaft member 11.

The hollow shaft member 11 has at least two shaft fixing surfaces 11A which are made of, for example, a steel pipe and are formed on a portion corresponding to a position between cylinders (or a position between the cam lobe pieces 12) by plasticity process. The shaft fixing surface 11A functions as a rotation brake of the shaft member 11 at the time of fastening the sprocket 14.

Since the hollow shaft member 11 has the shaft fixing surface 11A, it does not require additional parts such as a hexagonal nut shaped part. Therefore, an increase in cost due to an increase in number of parts and a loss of a lightening effect do not occur. Moreover, a special exclusive (sole) working tool (for example, a wrench having a square aperture or an octagon aperture) is not necessary, and the camshaft 10 can be easily attached/detached by a working tool such as a spanner.

Further, since the shaft fixing surface 11A is formed by the plasticity process, a decrease in its thickness is suppressed, and lightening of the parts is not hindered and securing of mechanical durability is easy.

A number of the shaft fixing surfaces 11A is not particularly limited as long as it is at least two. In this connection, for example, in the case where they are composed of a pair of parallel surfaces, the forming is easy and thus producibility is excellent.

Meanwhile, in the case where plural parallel pairs of the shaft fixing surfaces 11A are provided so that cross sections of the portions provided with the shaft fixing surfaces 11A have a polygonal shape (for example, a hexagon), an inserting direction of the working tool and a rotating position of the hollow shaft member 11 are not restrained. Therefore, satisfactory workability can be secured, and handling by means of the working tool is easy so that the workability is excellent.

It is preferable that a diameter of the portion provided with the shaft fixing surface 11A is smaller than an original diameter of the hollow shaft member 11. In this case, an interference between the tool and the parts difficulty occurs, so that more satisfactory maintainability (assembly workability) can be secured. A degree of design freedom of the engine, particularly a cylinder head portion can be improved.

Since the shaft fixing surface 11A is formed on the portion corresponding to the position between the cylinders, a distance between the cam lobe pieces is long. Therefore, since a working space can be easily secured, the working tool can be easily inserted. Namely, the interference between the working tool and the parts hardly occurs, so that the satisfactory assembly workability can be secured.

Further, since the distance between the cam lobe pieces is long, the shaft fixing surfaces 11A can be arranged easily so that deformation of the hollow shaft member 11 which is caused by the forming of the shaft fixing surfaces 11A does not influence the fastened portion of the cam lobe pieces 12. Therefore reliability of fastening forces of the cam lobe pieces 12 can be secured.

The position of the shaft fixing surface 11A is not particularly limited as long as it corresponds to the position between the cylinders. However, in the case where the shaft fixing surface 11A is arranged between the cylinders positioned on a rightmost side far from the sprocket 14 (a vicinity of the other end on an opposite side to one end fastened to the sprocket), this is particularly preferable from a viewpoint of the assembly workability. Moreover, in order to improve the lightening, when the thickness of the hollow shaft member 11 is thinned, the shaft fixing surface 11A may be arranged on a leftmost side between the cylinders (one end side) so that distortion might not occur on the hollow shaft member 11.

Figure 2:
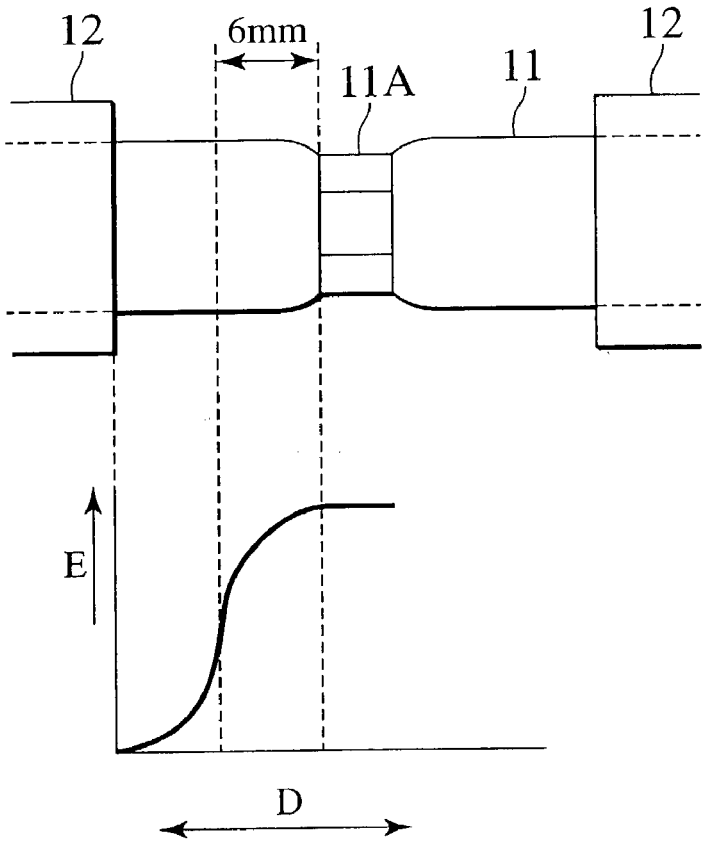
FIG. 2 is a diagram for explaining a deforming influence range due to forming of a shaft fixing surface.

FIG. 2 is a diagram for explaining a deformation influence range due to the forming of the shaft fixing surfaces 11A. The applied hollow shaft member (steel pipe) 11 has an outer diameter of 25.5 mm and a thickness of 3.3 mm. A distance between the cam lobe pieces is 23 mm.

As shown in FIG. 2, the influence range of the deformation of the hollow shaft member 11 caused by the forming of the shaft fixing surface 11A is about 6 mm (distance D). Namely, in the case where the shaft fixing surface 11A is arranged on a portion separated by not less than 6 mm from an end surface of the adjacent cam lobe piece 12, an amount of the deformation E of the hollow shaft member 11 does not influence the fastened portion of the cam lobe piece 12.

Therefore, in order to ensure the reliability of the fastening forces of the cam lobe pieces 12, it is preferable that the shaft fixing surface 11A is arranged on a portion separated by not less than 6 mm from the end surface of the adjacent cam lobe piece 12. Moreover, in the case where a size of the shaft fixing surface 11A is increased to be optimized, the workability is further improved.

Also in the case where the distance between the cam lobe pieces is 21 mm, the influence range of the deformation of the hollow shaft member 11 show the approximately same effect. Further, also in the case where a material of the hollow shaft member 11 is changed, the influence range shows the approximately same effect. Namely, the influence range of the deformation of the hollow shaft member 11 has small dependency with respect to the material and the distance between the cam lobe pieces 12.

In this connection, in case the distance between the cam lobe pieces 12 is narrow, it is another appropriate way where the shaft fixing surface 11A is formed at a middle portion of the distance between the cam lobe pieces 12. As mentioned above, the assembled camshaft 10 is light and has the satisfactory mechanical durability and maintainability.

Next, a production method of the assembled camshaft 10 will be explained below. The production method of the assembled camshaft 10 has, as shown in FIGS. 3A through 3E, the inserting step, the mouth expanding fastening step, the surface forming step and the bending correcting step.

Figure 3A:
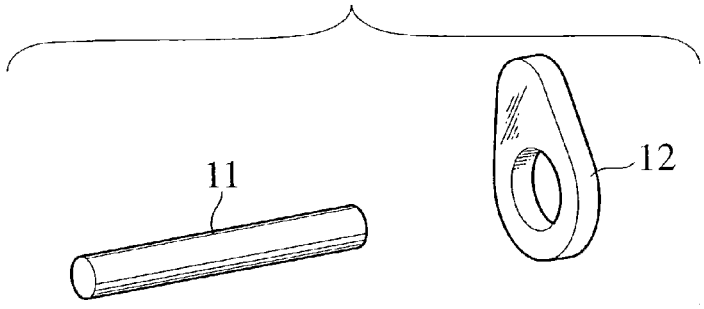
FIGS. 3A, 3B, 3C, 3D and 3E are diagrams for explaining a production method of the assembled camshaft for engine according to the embodiment of the present invention.
Figure 3B:
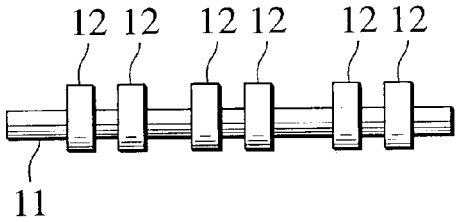

At the inserting step, as shown in FIG. 3B, a predetermined number of the cam lobe pieces 12 are inserted into the hollow shaft member 11 so as to be located.

Figure 3C:
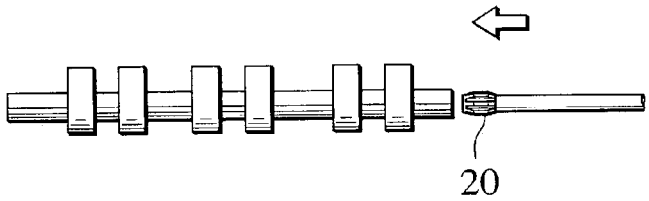

At the mouth expanding fastening step, as shown in FIG. 3C, a mandrel 20 is inserted into a hollow portion of the hollow shaft member 11, and a mouth of the hollow shaft member 11 is expanded and caulked, so that the cam lobe pieces 12 are fastened mechanically to the hollow shaft member 11.

More specifically, apertures of the cam lobe pieces 12 through which the hollow shaft member 11 is passed are shaped as polygon, for example, pentagon, hexagon, octagon. Therefore, after the mouth expanding fastening step, each of the cam lobe pieces 12 is refrained from rotating around the hollow shaft member 11 by concave portions and convex portions due to the polygonal shape of the apertures of the cam lobe pieces 12.

Figure 3D:
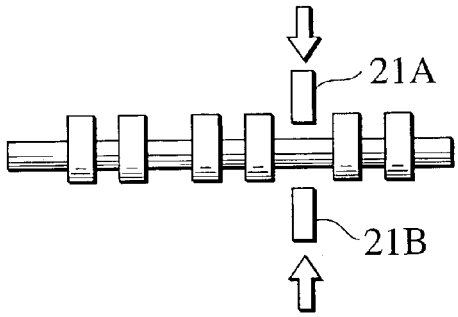

At the surface forming step, as shown in FIG. 3D, at least two shaft fixing surfaces 11A are formed on the portion of the hollow shaft member 11 corresponding to the position between the cylinders by plasticity processing tools 21A, 21B. At this time, since the distance between the cam lobe pieces is long, a degree of design freedom of the plasticity processing tools 21A, 21B for forming the shaft fixing surfaces 11A is large. Therefore, in this production method, the plasticity processing tools 21A, 21B which have large rigidity and a long life can be used.

Figure 4A:
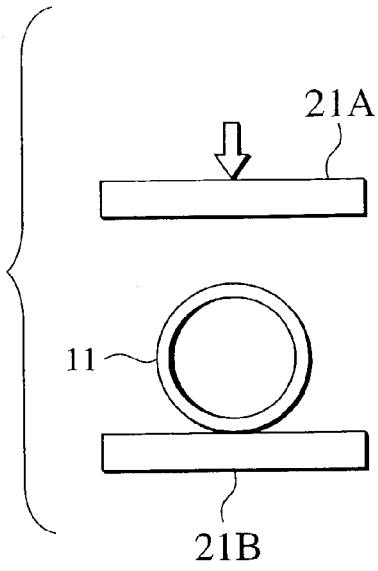
FIGS. 4A and 4B are cross sectional views for explaining one example of a plasticity processing tool for forming the shaft fixing surface.
Figure 4B:
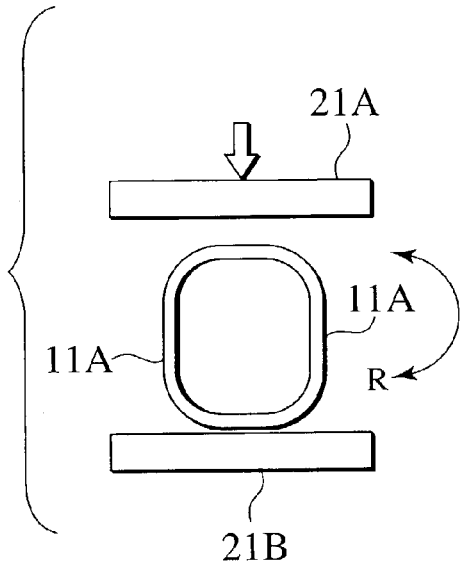
Figure 5:
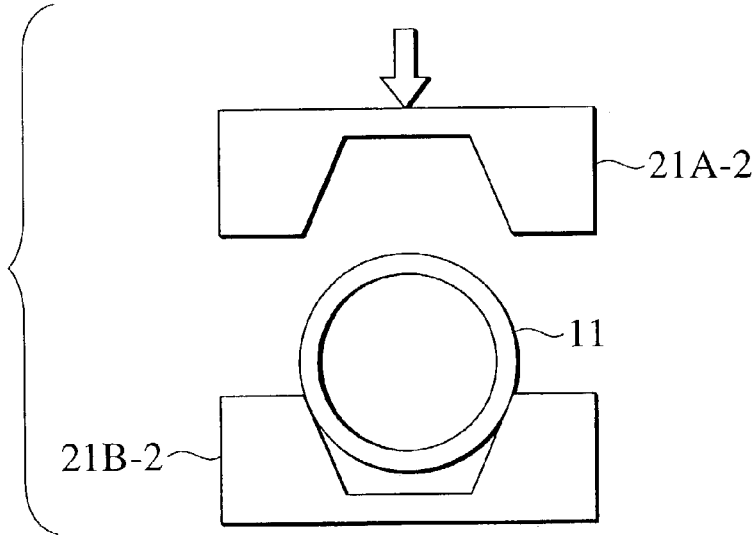
FIG. 5 is a cross sectional view for explaining another example of the plasticity processing tool for forming the shaft fixing surface.

FIGS. 4A and 4B and FIG. 5 show examples of the plasticity processing tools 21A, 21B, 21A-2, 21B-2. Unlike the polygonal plasticity processing tools (die) 21A-2, 21B-2 shown in FIG. 5, in the case of the flat plasticity processing tools (die) 21A, 21B shown in FIG. 4A, after a pair of parallel surfaces are formed, the hollow shaft member 11 is rotated to a direction of R. Consequently, in a state where the hollow shaft member 11 is kept to be refrained from rotating in the direction of R, the shaft fixing surfaces are formed again by the plasticity processing tools 21A, 21B as shown in FIG. 4B repeatedly, so that the polygonal shaft fixing surfaces 11A are formed.

The surface forming step does not influence the mouth expanding fastening step because this step is executed after the mouth expanding fastening step.

Figure 3E:
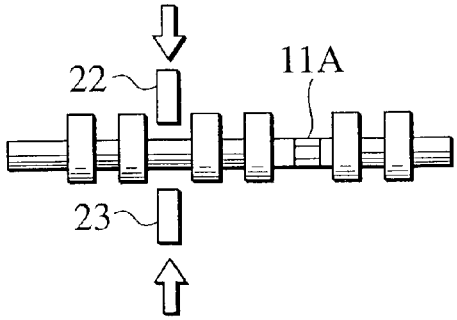

At the bending correcting step, as shown in FIG. 3E, bending of the hollow shaft member 11 which occurs in the mouth expanding fastening step and the surface forming step is corrected. Namely, since the step of correcting the bending based on the mouth expanding fastening step and the step of correcting the bending based on the surface forming step are executed simultaneously at one time, an increase in steps is prevented so that a line is shortened and the cost is reduced.

More specifically, at the bending correcting step shown in FIG. 3E, firstly the bending of the hollow shaft member 11 is measured. The portion, which requires the correction of the bending of the hollow shaft member 11 detected based on the measured result, is plastically deformed by pressurizing the portion to a direction crossing a longitudinal direction of the hollow shaft member 11 using the plasticity processing tool 22. A side which is opposite to the side pressurized by the plasticity processing tool is supported by a receiving section 23.

The hollow shaft member 11 whose bending is corrected proceeds to mechanical processing step (machining, grinding or lapping process). Therefore, at the mechanical processing step, bias of a machining allowance and remain of rough material surface are prevented from occurring, and rotational unbalance due to bias of the thickness after the process is prevented from occurring.

As explained above, the production method of the light assembled camshaft for engine having the satisfactory mechanical durability and maintainability can be provided.

Next, a plasticity processing device which is applied to the bending correcting step will be explained.

Figure 6:
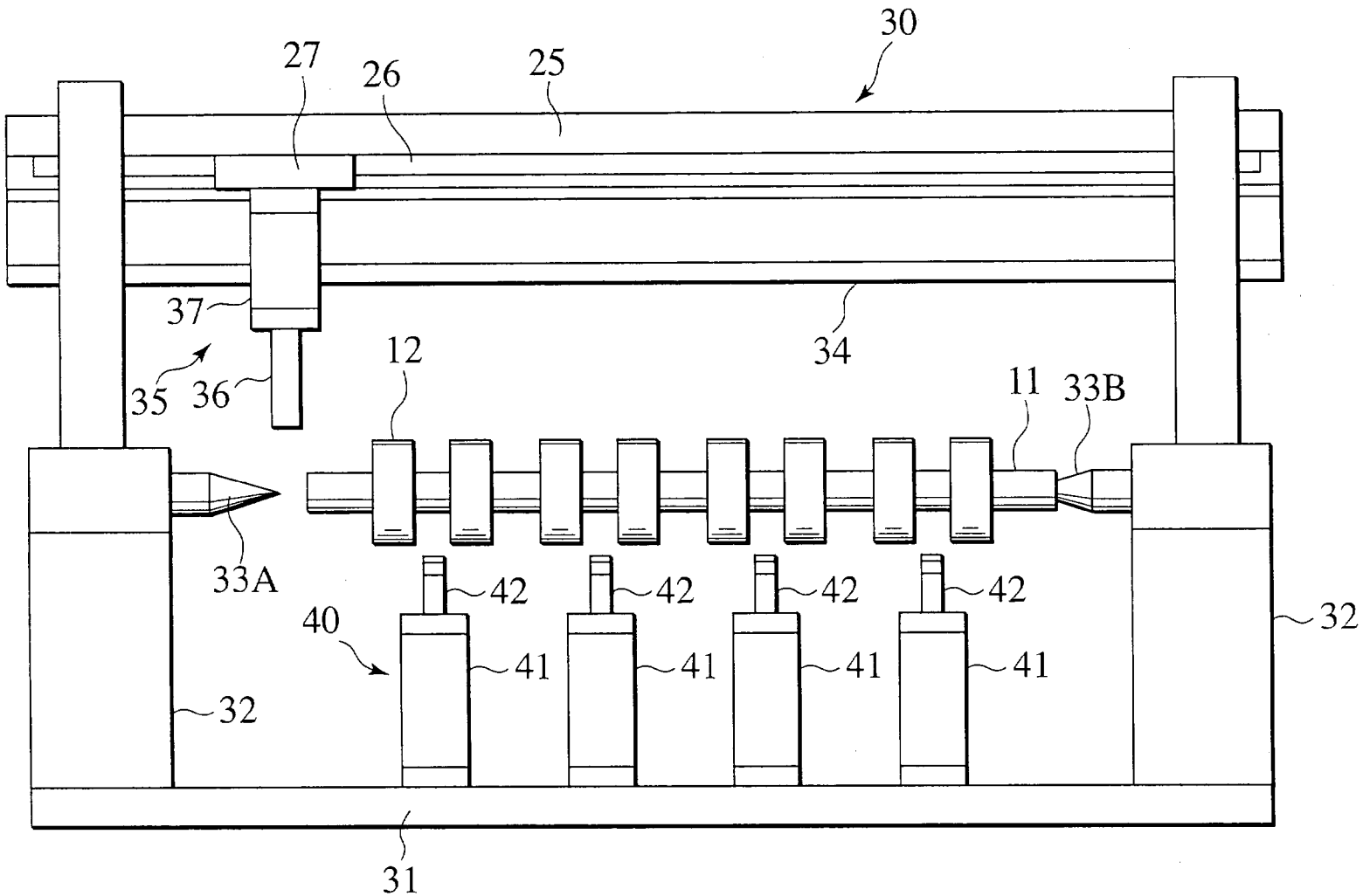
FIG. 6 is a front view for explaining a plasticity processing device according to the embodiment of the present invention.

As shown in FIG. 6, a plasticity processing device 30 has a base section 31, a column section 32, an upper frame 25, a rail section 26, a guide rail section 34, a bending correcting section 35 and a receiving stand section 40.

Figure 7:
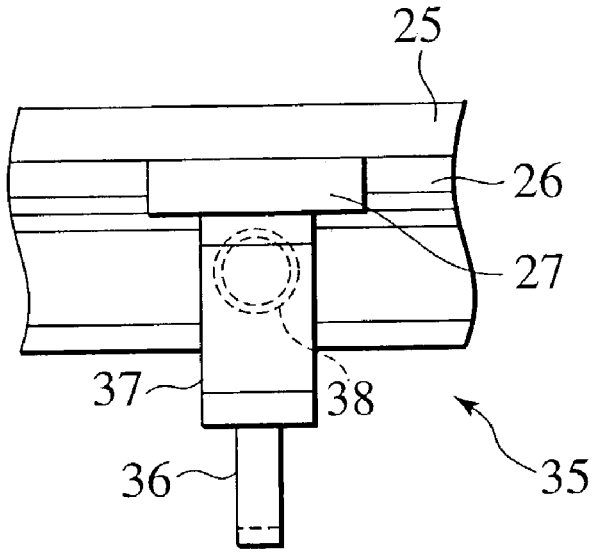
FIG. 7 is a front view for explaining a bending correcting portion shown in FIG. 6.
Figure 8:
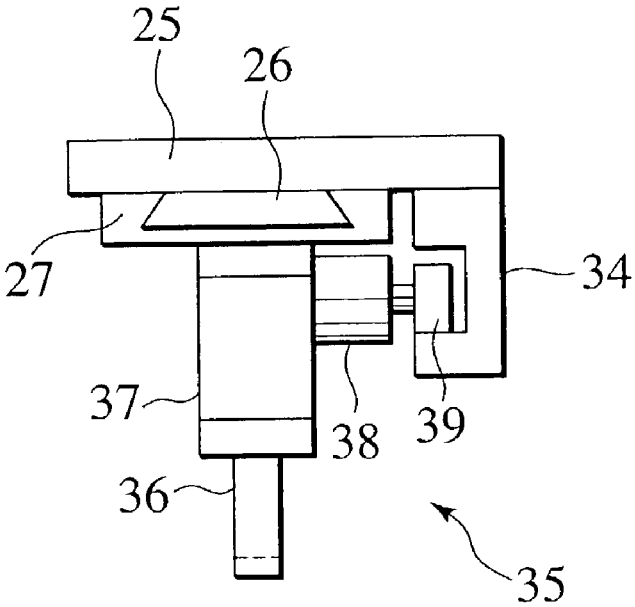
FIG. 8 is a side view for explaining the bending correcting portion shown in FIG. 6.

The column section 32 is arranged on both sides of the base section 31, and the guide rail section 34 is fixed to upper portions of the column sections 32. The column sections 32 have supporting units 33A, 33B for supporting and rotating the hollow shaft member 11, respectively. One 33A of the supporting units 33A, 33B is driven to the longitudinal direction (a right-left direction in FIG. 6) and the supporting unit 33B is driven to be rotated. The bending correcting section 35, as shown in FIGS. 7 and 8, has a slide section 27 sliding on the rail section 26, a press rod 36, a cylinder section 37, a servomotor 38 and a roller 39.

The press rod 36 has a plasticity processing tool for correcting the bending, and is driven by the cylinder section 37 composed of reciprocating linear movement driving means such as a hydraulic cylinder and freely moves to an up-down direction. The cylinder section 37 is supported to the rail section 26 and the guide rail section 34 so as to freely move. Moreover, the servomotor 38 is mounted to the cylinder section 37. When the roller 39 which is rotated by the servomotor 38 rotates on the guide rail section 34, the cylinder section 37 moves right and left in FIG. 6.

Therefore, the press rod 36 freely approaches or separates from the hollow shaft member 11 supported by the supporting units 33A, 33B and freely moves to the longitudinal direction of the hollow shaft member 11 (shaft direction).

Figure 9:
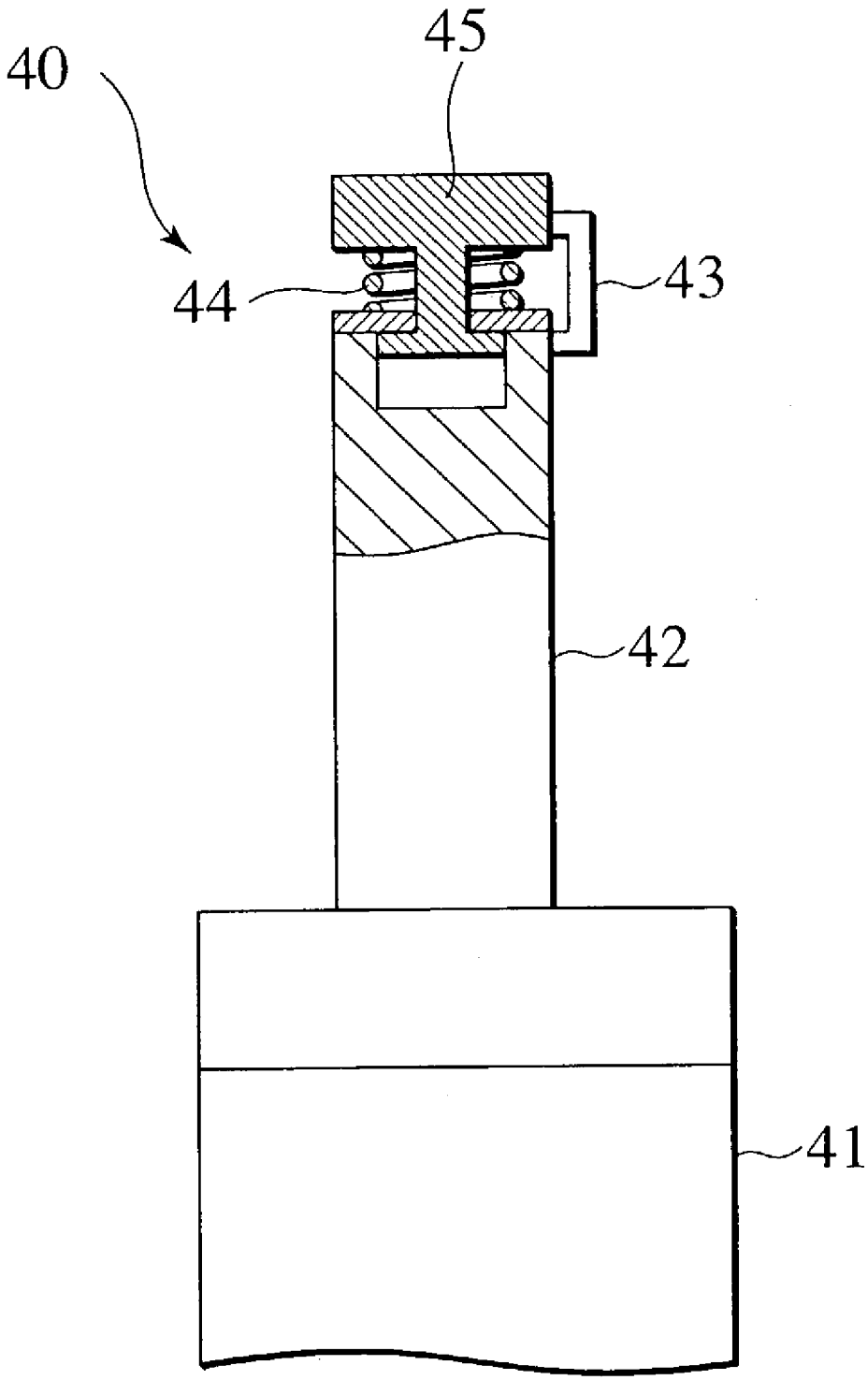
FIG. 9 is a partially sectional view for explaining a receiving stand section show in FIG. 6.

The receiving stand section 40 has a cylinder section 41 and a receiving section 42. The receiving section 42 is driven by the cylinder section 41 composed of the reciprocating linear movement driving means such as a hydraulic cylinder so as to freely move to a desirable position in the up-down direction. Moreover, the receiving section 42, as shown in FIG. 9, has a position sensor 43, a spring (elastic member) 44 and a contactor 45, and can detect the bending of the hollow shaft member 11. The spring 44 has a buffer function when the receiving section 42 comes in contact with the hollow shaft member 11 so as to be located.

Figure 10:
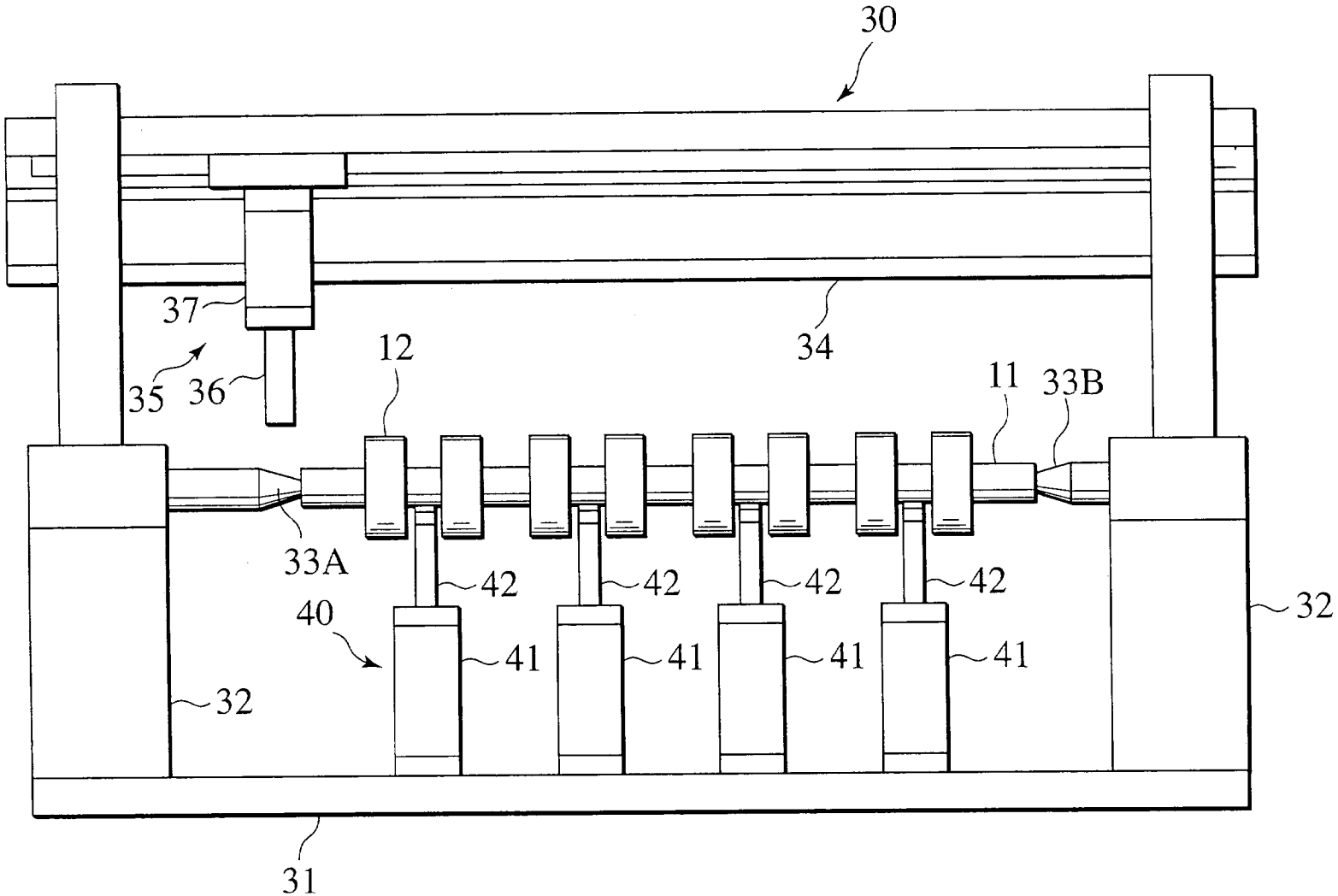
FIG. 10 is a front view for explaining bending measurement by means of the plasticity processing device of FIG. 6.

Next, the bending measurement by means of the plasticity processing device 30 will be explained blow with reference to FIG. 10.

Firstly, after one end of the hollow shaft member 11 which was subject to the surface forming step is located on the supporting unit 33B, the supporting unit 33A is advanced and comes in contact with the other end of the hollow shaft member 11 so that the hollow shaft member 11 is supported. Next, all the receiving stand sections 40 are operated. Namely, the respective receiving sections 42 are raised by the cylinder sections 41, respectively, so as to come in contact with the hollow shaft member 11.

While the hollow shaft member 11 is being rotated by the supporting unit 33B, the measurement is executed by the position sensors 43 of the receiving sections 42. As a result, a position and a deforming amount in the longitudinal direction of portions of the hollow shaft member 11 requiring the bending correction are detected.

Figure 11:
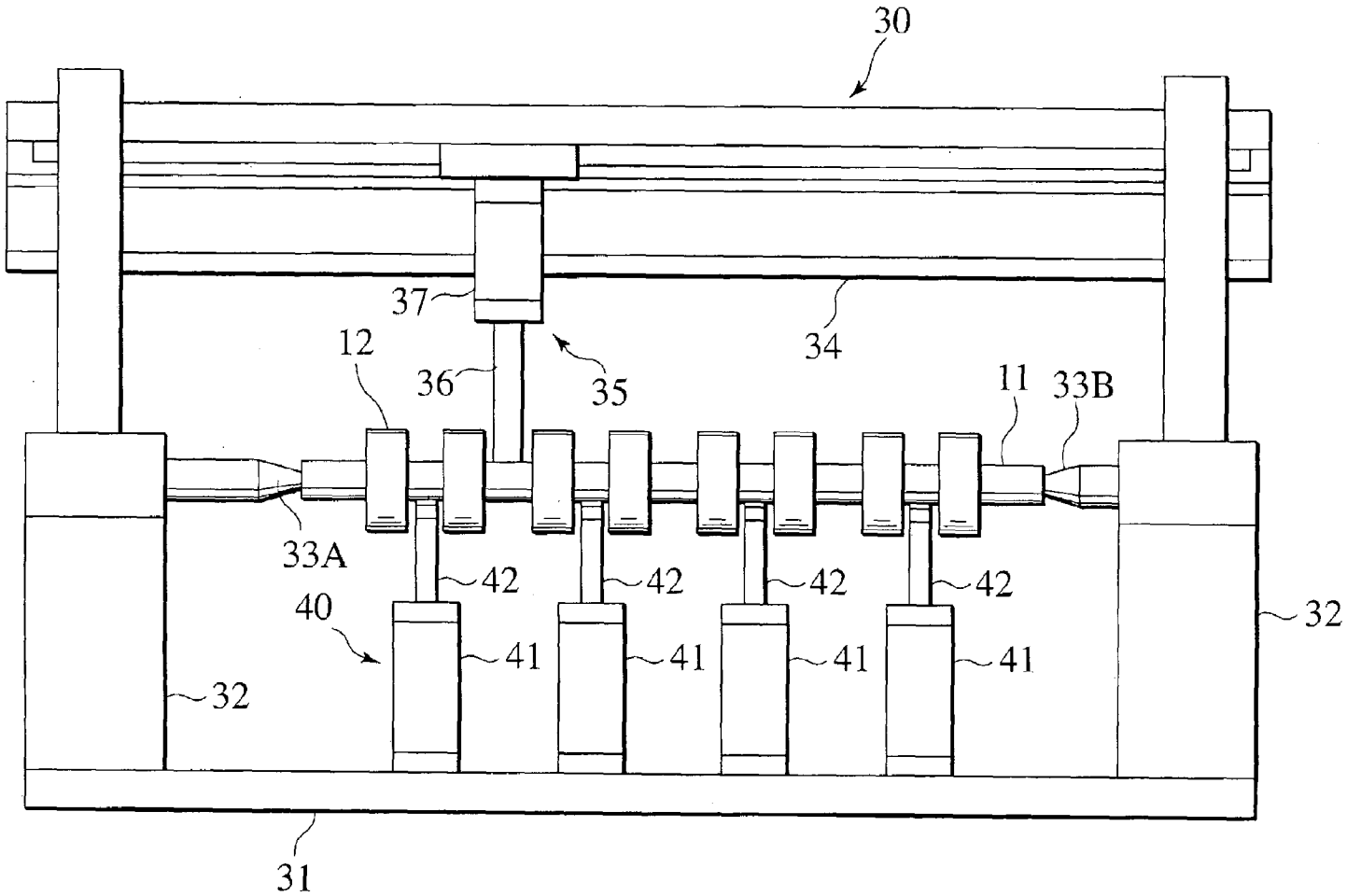
FIG. 11 is a front view for explaining plasticity deformation by means of the plasticity processing device of FIG. 6.

Next, the bending correction by means of the plasticity processing device 30 will be explained with reference to FIG. 11.

Firstly, the servomotor 38 is controlled based on the bending measured result, and the bending correcting section 35 is driven along the guide rail section 34 (the longitudinal direction of the hollow shaft member 11) so as to be located above the portion requiring the bending correction.

Next, the receiving stand sections 40, which are arranged on positions where the portion requiring the bending correction is sandwiched, are operated. The receiving sections 42 are raised to a most advancing position by the cylinder sections 41 so as to support the hollow shaft member 11.

The press rod 36 of the bending correcting section 35 is lowered by the cylinder section 37 so as to pressurize the portion requiring the bending correction (to a direction crossing the longitudinal direction of the hollow shaft member 11) and plastically deform the portion according to a detected deforming amount. If necessary, the hollow shaft member 11 is rotated by the supporting unit 33B.

The bending correction is repeated on all the portions requiring the bending correction so that the bending of the hollow shaft member 11 in the longitudinal direction is corrected.

Figure 12:
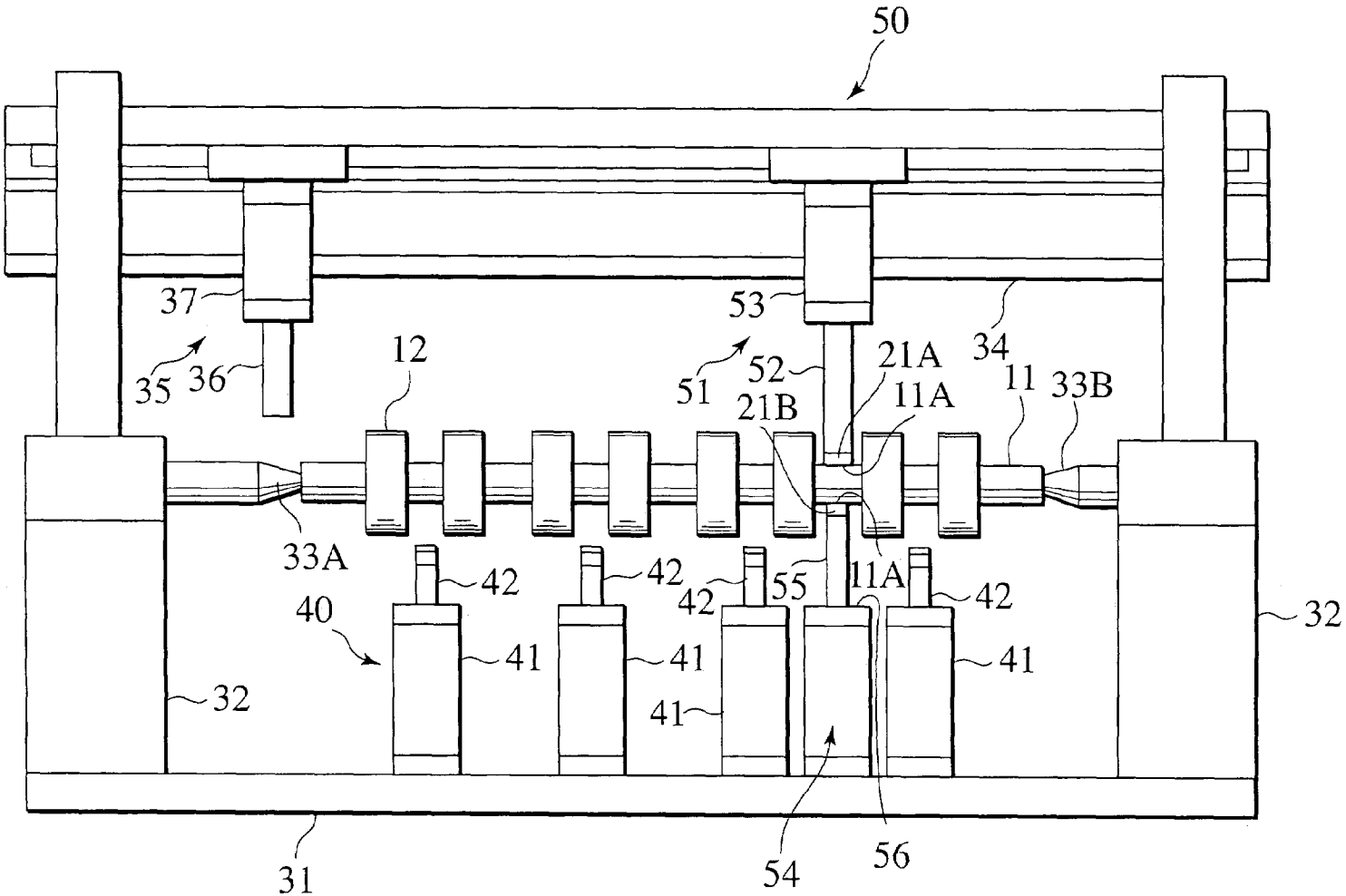
FIG. 12 is a front view for explaining a modified example of the plasticity processing device according to the embodiment of the present invention.

FIG. 12 is a front view for explaining a modified example of the plasticity processing device according to the embodiment of the present invention. The plasticity processing device 50 further has an upper forming section 51 and a lower forming section 54 unlike the plasticity processing device 30 shown in FIGS. 6 through 11.

The upper forming section 51 has, for example, a press rod 52 having the plasticity processing tool 21A shown in FIGS. 4 and 5, and a cylinder section 53 for driving the press rod 52, and it is used for forming the shaft fixing surface on an upper surface of the hollow shaft member 11.

The lower forming section 54 has, for example, a press rod 55 having the plasticity processing tool 21B shown in FIGS. 4 and 5, and a cylinder section 56 for driving the press rod 55, and it is used for forming the shaft fixing surface on a lower surface of the shaft fixing member 11.

The upper forming section 51 has another servomotor and another roller similarly to the bending correcting section 35, and it freely moves along the guide rail section 34 to the longitudinal direction of the hollow shaft member 11. For this reason, the upper forming section 51 moves to a retreating position at the time of the bending correction, and thus interference between the upper forming section 51 and the bending correcting section 35 does not occur.

Meanwhile, the lower forming section 54 is arranged below the position between the cylinders where the shaft fixing surface is formed and between the receiving stand sections 40. Therefore, since the lower forming section 54 waits in a state that the press rod 55 is lowered at the time of the bending correction, the operation of the receiving stand sections 40 is not obstructed.

Next, the surface forming step by means of the plasticity processing device 50 will be explained.

Firstly, after one end of the hollow shaft member 11 which was subject to the mouth expanding fastening step is located on the supporting unit 33B, the supporting unit 33A is advanced to a right direction in FIG. 12 so as to come in contact with the other end of the hollow shaft member 11, and thus the hollow shaft member 11 is supported.

Next, the upper forming section 51 moves from the retreating position to above the position between the cylinders, and the press rod 52 is lowered towards the hollow shaft member 11. Meanwhile, the lower forming section 54 raises the press rod 55 towards the hollow shaft member 11.

The shaft fixing surfaces are formed on the portions of the hollow shaft member 11 corresponding to the position between the cylinders by the plasticity processing tools 21A, 21B of the press rod 52 and the press rod 55.

Figure 13:
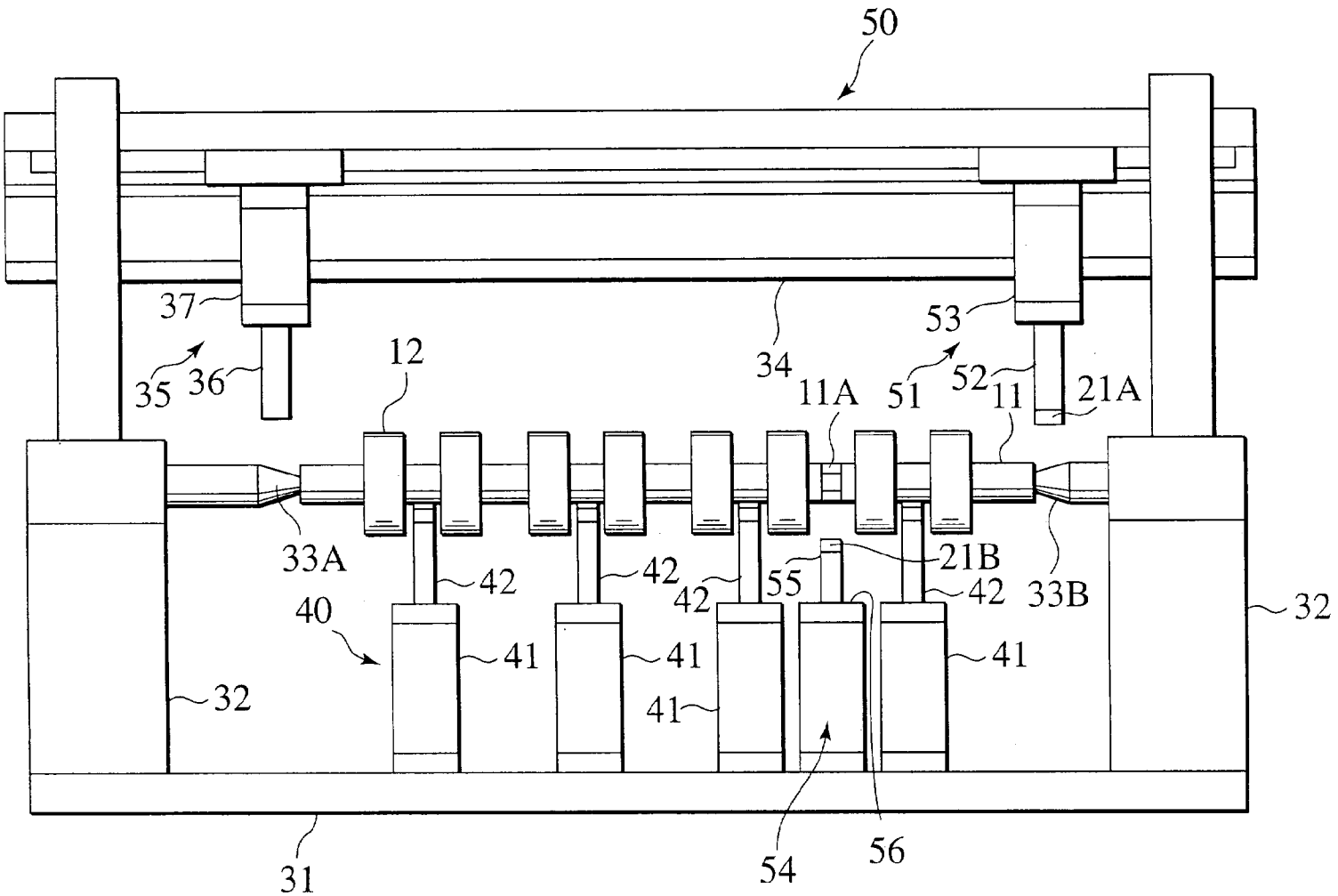
FIG. 13 is a front view showing bending correcting step by means of the plasticity processing device of FIG. 12.

The bending correcting step by means of the plasticity processing device 50 is similar to the bending correcting step by means of the plasticity processing device 30 except that the upper forming section 51 is arranged on the retreating position and the press rod 5 of the lower forming section 54 is lowered as shown in FIG. 13. Therefore, the explanation thereof is not repeated.

As mentioned above, the plasticity processing device 50 has the function for forming the shaft fixing surface and the function for correcting the bending of the hollow shaft member, and executes the surface forming step and the bending correcting step continuously in one-time chucking. Therefore, a number of the steps can be reduced and the cost of productive facilities can be reduced.

The entire contents of Japanese Patent Application P2002-172952 (filed on Jun. 13, 2002) are incorporated herein by reference.

Although the invention has been described above by reference to certain embodiments of the invention, the invention is not limited to the embodiments described above. Modifications and variations of the embodiments descried above will occur to those skilled in the art, in light of the above teachings. The scope of the invention is defined with reference to the following claims.

What is claimed is:

1. An assembled camshaft for an engine, comprising:

a cam lobe piece; and a hollow shaft member having at least two shaft fixing surfaces formed by a plasticity process on a portion of the hollow shaft member corresponding to a position between cylinders of the engine, the at least two shaft fixing surfaces including at least two flat faces facing parallel to each other, wherein the at least two shaft fixing surfaces are formed to prevent the camshaft from rotating by engaging with a spanner when a sprocket is rotatably fastened to the camshaft; and wherein the at least two shaft fixing surfaces are formed directly on at least two outer peripheral portions of the hollow shaft member in a manner that the at least two outer peripheral portions of the hollow shaft member are pressed by at least two other flat faces facing parallel to each other of at least two plasticity processing tools located at an outside surface of the hollow shaft member.

2. An assembled camshaft for an engine according to claim 1, further comprising:

another cam lobe piece, wherein the two shaft fixing surfaces are formed on a portion of the hollow shaft member between the two cam lobe pieces.

3. An assembled camshaft for an engine according to claim 2, wherein the two shaft fixing surfaces are located on a portion of the hollow shaft member at a middle portion between the two cam lobe pieces.

4. An assembled camshaft for an engine according to claim 1, wherein a diameter of the portion provided with a shaft fixing surface is smaller than a diameter of said hollow shaft member.

5. An assembled camshaft for an engine according to claim 1, wherein the shaft fixing surfaces are separated by not less than 6 mm from an end surface of an adjacent cam lobe piece.

6. An assembled camshaft for an engine according to claim 1, wherein a cross section of the portion of said hollow shaft member provided with a shaft fixing surface has a polygonal shape.

7. A production method of an assembled camshaft for an engine having a cam lobe piece and a hollow shaft member, comprising the steps of:

forming at least two shaft fixing surfaces including at least two flat faces facing parallel to each other on at least two portions of the hollow shaft member by using at least two other flat faces facing parallel to each other of at least two plasticity processing tools at a portion of the hollow shaft member corresponding to a position between cylinders of the engine, wherein the at least two shaft fixing surfaces are formed to prevent the camshaft from rotating by engaging with a spanner when a sprocket is rotatably fastened to the camshaft; and wherein the at least two shaft fixing surfaces are formed directly on at least two outer peripheral portions of the hollow shaft member in a manner that the at least two outer peripheral portions of the hollow shaft member are pressed by the at least two plasticity processing tools located at an outside surface of the hollow shaft member.

8. A production method of an assembled camshaft for an engine according to claim 7, wherein the two shaft fixing surfaces are formed on a portion of the hollow shaft member between two cam lobe pieces in case the hollow shaft member has two cam lobe pieces.

9. A production method of an assembled camshaft for an engine according to claim 8, wherein the two shaft fixing surfaces are located on a portion of the hollow shaft member at a middle portion between the two cam lobe pieces.

10. A production method of an assembled camshaft for an engine according to claim 7, further comprising the step of:

expanding a mouth of said hollow shaft member so that the cam lobe piece is fastened to the hollow shaft member, wherein the forming step to form the shaft fixing surfaces is executed after the expanding step to expand the mouth of the hollow shaft member.

11. A production method of an assembled camshaft for an engine having a cam lobe piece and a hollow shaft member, comprising the steps of:

forming at least two shaft fixing surfaces on a portion of the hollow shaft member using a plasticity processing tool at a portion of the hollow shaft member corresponding to a position between cylinders of the engine; and correcting the hollow shaft member to be straight, wherein the forming step to form the shaft fixing surfaces and the correcting step to correct the hollow shaft member to be straight are executed in a state that said hollow shaft member is continuously fixed to a producing device, and wherein the correcting step to correct the hollow shaft member to be straight comprises the steps of:

measuring a bent status of the hollow shaft member;

detecting a correction portion and correction amount of the hollow shaft member which is to be corrected based on a measured result measured at the measuring step; and pressurizing by a plasticity processing tool to a direction crossing a longitudinal direction of the hollow shaft member so that the hollow shaft member is plastically deformed so as to be straight.

12. A production method of an assembled camshaft for an engine having a cam lobe piece and a hollow shaft member, comprising the steps of:

forming at least two shaft fixing surfaces on a portion of the hollow shaft member using a plasticity processing tool at a portion of the hollow shaft member corresponding to a position between cylinders of the engine; and correcting the hollow shaft member to be straight, wherein the forming step to form the shaft fixing surfaces is executed before the correcting step correcting the hollow shaft member to be straight, and wherein the correcting step to correct the hollow shaft member to be straight comprises the steps of:

measuring a bent status of the hollow shaft member;

detecting a correction portion and correction amount of the hollow shaft member which is to be corrected based on a measured result measured at the measuring step; and pressurizing by a plasticity processing tool to a direction crossing a longitudinal direction of the hollow shaft member so that the hollow shaft member is plastically deformed so as to be straight.

13. An assembled camshaft for an engine, comprising:

a cam lobe piece; and a hollow shaft member having at least two shaft fixing surfaces including at least two flat faces facing parallel to each other, wherein the assembled camshaft is produced by the following steps:

forming the at least two shaft fixing surfaces on at least two portions of the hollow shaft member by using at least two other flat faces facing parallel to each other of at least two plasticity processing tools at a portion of the hollow shaft member corresponding to a position between cylinders of the engine, wherein the at least two shaft fixing surfaces are formed to prevent the camshaft from rotating by engaging with a spanner when a sprocket is rotatably fastened to the camshaft; and wherein the at least two shaft fixing surfaces are formed directly on at least two outer peripheral portions of the hollow shaft member in a manner that the at least two outer peripheral portions of the hollow shaft member are pressed by the at least two plasticity processing tools located at an outside surface of the hollow shaft member.

14. An assembled camshaft for an engine according to claim 13, wherein before the shaft fixing surfaces are formed, the mouth of the hollow shaft member is expanded so that the cam lobe piece is fixed to the hollow shaft member.

15. An assembled camshaft for an engine, comprising:

a cam lobe piece; and a hollow shaft member having at least two shaft fixing surfaces including at least two flat faces facing parallel to each other, wherein the assembled camshaft is produced by the following steps:

forming at least two shaft fixing surfaces directly on a portion of the hollow shaft member by using at least two other flat faces facing parallel to each other of a plasticity processing tool at a portion of the hollow shaft member corresponding to a position between cylinders of the engine, wherein before the shaft fixing surfaces are formed, the mouth of the hollow shaft member is expanded so that the cam lobe piece is fixed to the hollow shaft member, and wherein before the shaft fixing surfaces are formed, the hollow shaft member is corrected to be straight, after the cam lobe piece is fixed to the hollow shaft member.

16. An assembled camshaft for an engine according to claim 15, wherein the correcting operation to correct the hollow shaft member to be straight comprises the steps of:

measuring bent status of the hollow shaft member;

detecting correction portion and correction amount of the hollow shaft member which is to be corrected based on a measured result measured at the measuring step; and pressurizing by a plasticity processing tool to a direction crossing a longitudinal direction of the hollow shaft member so that the hollow shaft member is plastically deformed so as to be straight.

* * * * *